United States Patent [19]

Hintsch

[11] 4,445,546

[45] May 1, 1984

[54] METHOD OF OPERATING A WEAVING MACHINE

[75] Inventor: Otto Hintsch, Wallisellen, Switzerland

[73] Assignee: Sulzer Brothers Limited, Winterthur, Switzerland

[21] Appl. No.: 330,797

[22] Filed: Dec. 15, 1981

[30] Foreign Application Priority Data

Dec. 17, 1980 [CH] Switzerland ..... 9296/80

[51] Int. Cl.[3] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 3,782,422 | 1/1974 | Vermeulen | 139/435 |
| 3,821,972 | 7/1974 | Svaty et al. | 139/435 |
| 4,031,926 | 6/1977 | Zollinger et al. | 139/435 |
| 4,245,677 | 1/1981 | Suzuki | 139/435 |

FOREIGN PATENT DOCUMENTS

| | | | |
|---|---|---|---|
| 2328135 | 12/1974 | Fed. Rep. of Germany | 139/435 |

*Primary Examiner*—Henry Jaudon

*Attorney, Agent, or Firm*—Kenyon & Kenyon

[57] ABSTRACT

The nozzles which are distributed over the width of the weaving machine remain activated after the passage of a weft yarn and are deactivated simultaneously upon termination of picking. Picking can be performed with fluid at a relatively low pressure so that the compressor for delivering the fluid can be relatively small.

4 Claims, 3 Drawing Figures

Fig.1
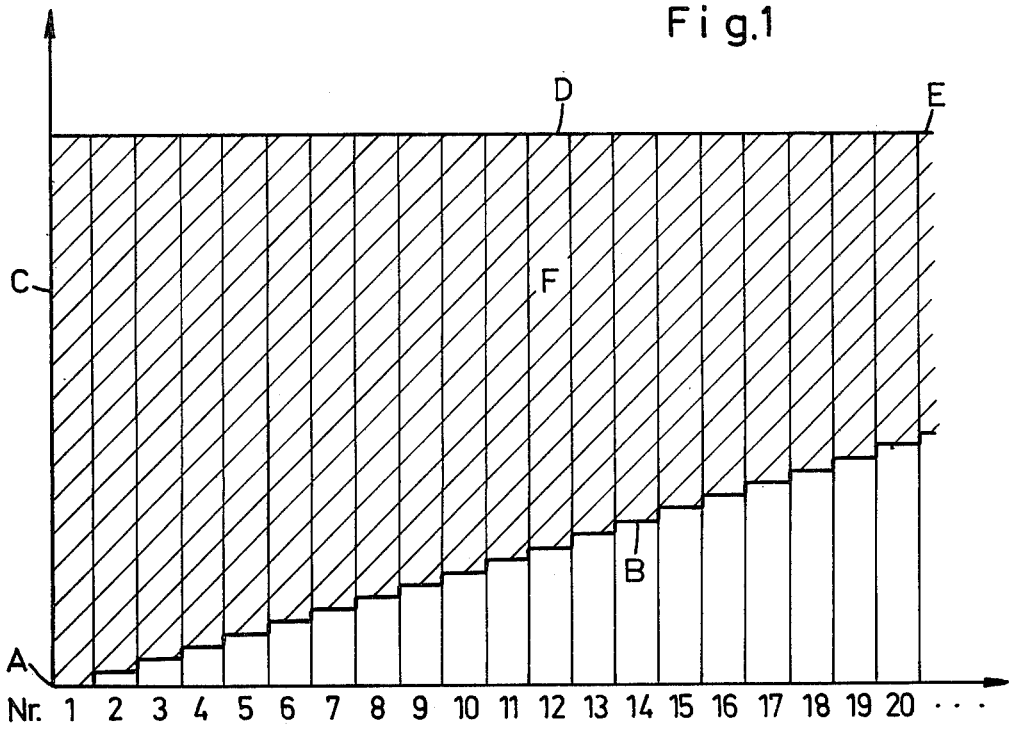
Fig.2a
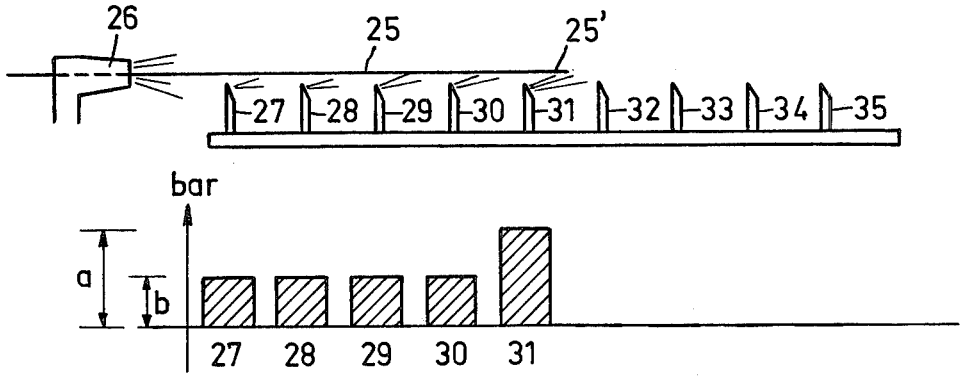
Fig.2b

METHOD OF OPERATING A WEAVING MACHINE

This invention relates to a method of operating a weaving machine. More particularly, this invention relates to a method of picking a weft yarn through a yarn travelling zone.

As is known, various types of weaving machines have been constructed in which a weft yarn can be picked through a travelling zone by means of a pressurized fluid. For example, it has been known to construct a pneumatic weaving machine wherein a pressurized fluid in the form of air is discharged by means of nozzles which are distributed over the weaving width to form a travelling zone for the weft yarn. Generally, during use, as described in German Offenlegungsschrift No. 2 328 135, the nozzles are sequentially actuated in order to move the weft yarn through the travelling zone. In addition, each nozzle has been rendered inoperative after the passage of the weft yarn except for a pair of nozzles, known as the back-up nozzles, which remain "on" throughout the remainder of picking. However, one disadvantage of this method is that the fluid pressure must be high. Hence, the power consumption of the compressor for delivering the pressurized fluid is substantial.

Accordingly, it is an object of the invention to utilize a low pressure compressor for pneumatically picking a weft yarn through a yarn zone of a weaving machine.

It is another object of the invention to provide a compressor of relatively small and inexpensive construction for picking a weft yarn through a yarn travelling zone of a pneumatic weaving machine.

It is another object of the invention to reduce the energy required for picking a weft yarn through a travelling zone of a pneumatic weaving machine.

Briefly, the invention provides a method of picking a weft yarn through a yarn travelling zone defined by a sequence of fluid discharge nozzles wherein each nozzle is sequentially actuated to eject a fluid medium into the travelling zone for propelling the weft yarn along the zone and wherein the nozzles are deactivated simultaneously upon termination of picking of the weft yarn through the travelling zone. In this way, the nozzles remain "on" after the passage of the weft yarn and are rendered inoperative simultaneously upon the termination of picking.

After passage of the weft yarn by a nozzle, the nozzle may be operated at a reduced pressure until the termination of picking.

These and other objects and advantages of the invention will become more apparent from the following detailed description taken in conjunction with the accompanying drawings wherein:

FIG. 1 graphically illustrates the timing sequence of a series of nozzles forming a travelling zone for a weft yarn;

FIG. 2*a* diagrammatically illustrates a modified embodiment of the method; and FIG. 2*b* graphically illustrates the manner of operation of the nozzles of FIG. 2*a*.

Referring to FIG. 1, the graph illustrates the timing of the actuation of a series of nozzles 1–20 which define a travelling zone for a weft yarn being inserted into a shed disposed across the weaving width of a pneumatic weaving machine. Each nozzle communicates by way of a valve (not shown) with a source (not shown) of pressure fluid, such as compressed air. The valves are controlled by the weaving machine and open seriatim starting at the time A. The opening of each valve is such that whenever the weft yarn has passed a nozzle, the next nozzle comes into operation, i.e. is supplied with compressed air.

The pattern of the onset of energization of the nozzles 1–20 is indicated by the stepped line B. The "on" time of each nozzle 1–20 is represented by the axis C. The deactivation of the nozzles 1–20 is indicated by the line D. As indicated, any nozzle 1–20, once activated, remains activated for the remainder of picking; there being no alteration in air pressure. After termination of picking of a weft yarn at position E, all the nozzles 1–20 are "switched off" simultaneously. The "on" time of each nozzle 1–20 is thus represented by a hatched area F between the lines B and D.

Since all the nozzles 1–20 cooperate in moving the weft yarn throughout picking, the picking operation is so efficient as to be performed with relatively low pressure air. Thus, a compressor for supplying the air can be of relatively small dimensions.

Referring to FIG. 2*a*, a pneumatic weaving machine may employ a main nozzle 26 for picking a weft yarn 25 into a shed (not shown) along which a series of nozzles 27–35 are positioned. Initially, the weft yarn 25 is pneumatically picked into the travelling zone defined by the adjacent nozzles 27–35 by the main nozzle 26 in a manner which is known. When the tip 25' of the yarn 25 has reached the shed, conveyance of the yarn is taken over by the nozzles 27–35. As indicated in FIG. 2*b*, each nozzle near the yarn tip 25', for example the nozzle 31, injects an air jet at a pressure of a bar. After the next nozzle 32 has been activated also at the pressure of a bar, the valve for the immediately previous nozzle 31 is closed to an extent such that the pressure in the nozzle 31 drops to a reduced value b. Consequently, near the end of picking, all the nozzles 27–35 are actuated at the same pressure b. Thereafter, all the nozzles 27–35 are deactivated (switched off) simultaneously.

The invention thus provides a method of operating a pneumatic picking arrangement of a pneumatic weaving machine at reduced energy levels. In this regard, the compressor utilized for pressurizing the fluid medium can be made for a lower pressure and, thus, may be made smaller and more economically than those larger compressors which have been previously used.

What is claimed is:

1. A method of picking a weft yarn through a yarn travelling zone defined by a sequence of fluid discharge nozzles, and disposed across the weaving width of a weaving machine, said method comprising the steps of sequentially actuating each nozzle in said zone to eject a fluid medium into said zone for propelling the weft yarn along said zone; and thereafter de-activating the nozzles simultaneously upon termination of picking of the weft yarn through said zone.

2. A method as set forth in claim 1 wherein each nozzle is initially actuated at a given pressure and remains actuated at a reduced pressure after passage of the weft yarn thereby until termination of picking.

3. A method of picking a weft yarn through a travelling zone comprising pneumatically picking the weft yarn into the travelling zone;

sequentially injecting each one of a series of adjacent air jets into said zone for propelling the weft yarn through said zone; and simultaneously de-activating the series of air jets upon termination of picking of the weft yarn through said zone.

4. A method as set forth in claim 3 which further comprises the step of reducing the pressure of each air jet to a low pressure value after passage of the weft yarn thereby until termination of picking.

* * * * *